US008303260B2

(12) United States Patent
Stavale et al.

(10) Patent No.: US 8,303,260 B2
(45) Date of Patent: Nov. 6, 2012

(54) METHOD AND APPARATUS FOR PUMP PROTECTION WITHOUT THE USE OF TRADITIONAL SENSORS

(75) Inventors: Anthony E. Stavale, Victor, NY (US); Nicolas W. Ganzon, Seneca Falls, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 637 days.

(21) Appl. No.: 11/601,373

(22) Filed: Nov. 17, 2006

(65) Prior Publication Data

US 2007/0212229 A1 Sep. 13, 2007

Related U.S. Application Data

(60) Provisional application No. 60/780,529, filed on Mar. 8, 2006, provisional application No. 60/780,546, filed on Mar. 8, 2006.

(51) Int. Cl.
*F04B 49/00* (2006.01)

(52) U.S. Cl. ..... 417/43; 417/42; 417/20; 417/22; 417/53; 73/861

(58) Field of Classification Search ..... 417/42, 417/43, 53; 73/861, 195, 196
See application file for complete search history.

(56) References Cited

U.S. PATENT DOCUMENTS

| | | | | |
|---|---|---|---|---|
| 4,108,574 | A * | 8/1978 | Bartley et al. | 417/19 |
| 4,468,219 | A | 8/1984 | George et al. | |
| 4,650,633 | A | 3/1987 | Youngborg | |
| 4,795,314 | A | 1/1989 | Prybella et al. | |
| 5,754,421 | A | 5/1998 | Nystrom | |
| 5,930,092 | A | 7/1999 | Nystrom | |
| 6,464,464 | B2 | 10/2002 | Sabini et al. | |
| 6,591,697 | B2 * | 7/2003 | Henyan | 73/861.71 |
| 6,709,241 | B2 * | 3/2004 | Sabini et al. | 417/53 |
| 6,715,996 | B2 * | 4/2004 | Moeller | 417/44.11 |
| 6,776,584 | B2 * | 8/2004 | Sabini et al. | 417/22 |
| 6,783,328 | B2 * | 8/2004 | Lucke et al. | 417/43 |
| 7,080,508 | B2 | 7/2006 | Stavale et al. | |
| 7,117,120 | B2 * | 10/2006 | Beck et al. | 702/182 |
| 7,591,777 | B2 * | 9/2009 | LaRose | 600/16 |
| 2002/0141875 | A1 | 10/2002 | Carstensen | |
| 2002/0150476 | A1 | 10/2002 | Lucke et al. | |
| 2003/0039556 | A1 * | 2/2003 | Sacher | 417/212 |
| 2004/0064292 | A1 | 4/2004 | Beck et al. | |
| 2004/0267395 | A1 * | 12/2004 | Discenzo et al. | 700/99 |
| 2005/0123408 | A1 | 6/2005 | Koehl | |
| 2005/0180855 | A1 | 8/2005 | Horiuchi et al. | |

FOREIGN PATENT DOCUMENTS

WO 2005/064167 A1 7/2005

OTHER PUBLICATIONS

Three pages, German Office Action dated May 20, 2009.
Three pages, English Translation of German Office Action dated May 20, 2009.

* cited by examiner

*Primary Examiner* — Charles Freay
*Assistant Examiner* — Christopher Bobish

(57) ABSTRACT

The present invention provides protection for centrifugal pumps while differentiating between dangerous operating conditions (e.g. dry running, minimum flow and runout) and/or conditions where transient conditions (e.g. closed valve operation) may occur and the protection can be revoked once the condition clears. The methodology utilizes a calculated flow value which can be mathematically determined from a calibrated closed valve power vs speed curve and/or various pump and motor parameters such as speed, torque, power and/or differential pressure or from calibrated flow curves stored in the evaluation device. The calculated flow value is then compared to threshold values of flow associated with these adverse operating conditions.

54 Claims, 2 Drawing Sheets

The Basic Logic of the Pump System

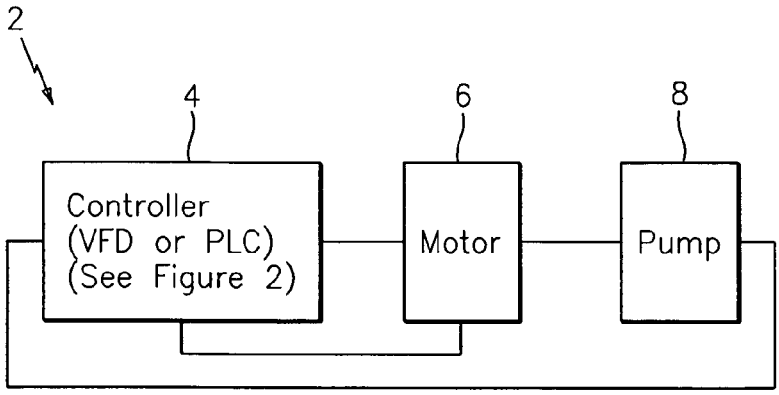
*FIG. 1* :The Basic Pump System
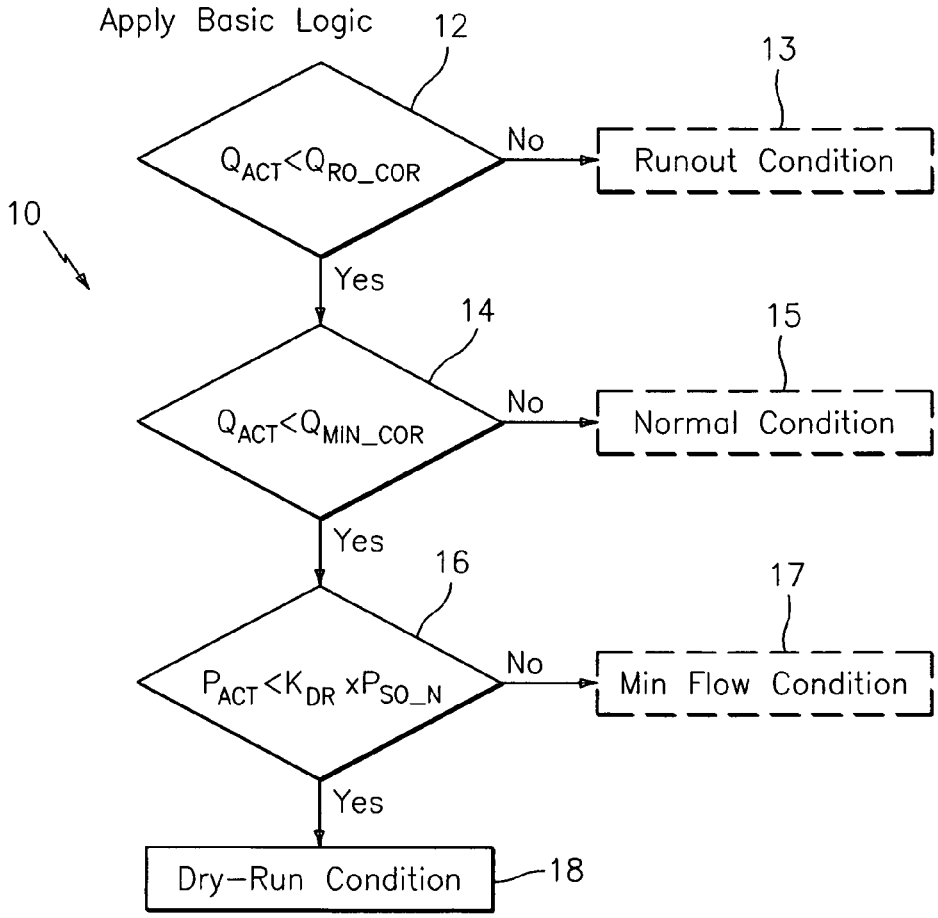
Note: $P_{ACT}$= Current Drive Power/SG
SG = Specific Gravity
*FIG. 2* :The Basic Logic of the Pump System

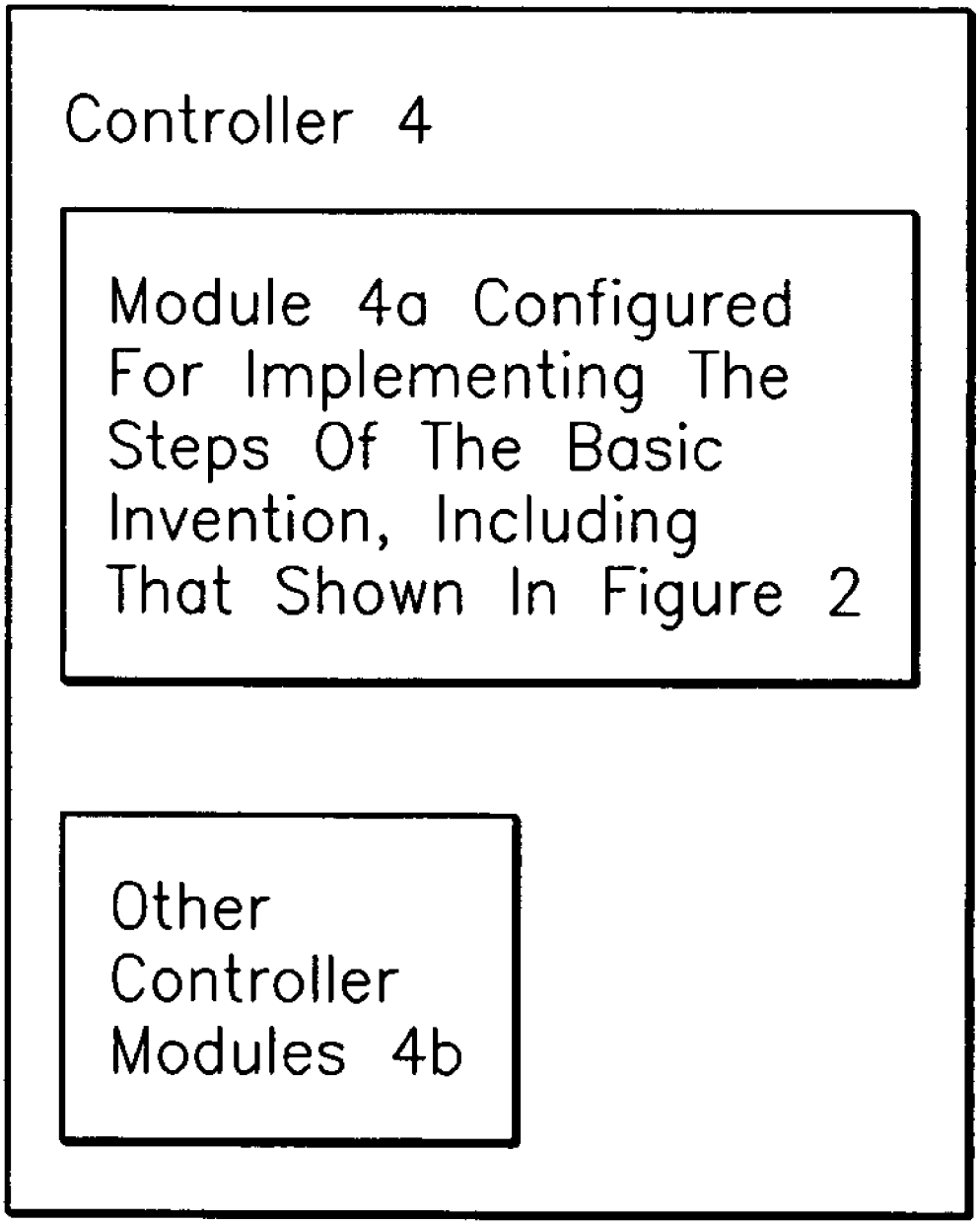
*FIG. 3* :The Controller 4

METHOD AND APPARATUS FOR PUMP PROTECTION WITHOUT THE USE OF TRADITIONAL SENSORS

CROSS-REFERENCE TO RELATED APPLICATIONS

This patent application claims benefit to provisional patent application Ser. No. 60/780,529, filed 8 Mar. 2006, entitled "Method for Pump Protection Without the Use of Traditional Sensors," (911-2.22-1/05GI002), and is also related to provisional patent application Ser. No. 60/780,546, filed 8 Mar. 2006, entitled "Method For Determining Pump Flow Without Traditional Sensors," (911-2.24-1/05GI003). Both of these provisional patent applications are incorporated herein by reference in their entirety.

BACKGROUND OF THE INVENTION

1. Field of the Invention

The present invention relates to a pump system having a pump, including a centrifugal pump; and more particularly to a method and apparatus for pump protection without the use of traditional sensors.

2. Brief Description of Related Art

Other similar devices and their shortcomings are as follows:

U.S. Pat. No. 7,080,508 discloses a method and apparatus for torque controlled pump protection with mechanical loss compensation," which is hereby incorporated by reference, and which provides control logic that utilizes the direct feedback of torque (or power) and speed to identify undesirable operating conditions and provide the appropriate operating response to protect the driven equipment (centrifugal pump) from damage. The logic can be imbedded in a variable speed drive or Programmable Logic Controller (PLC). However, this technique may be limited to pumps with constantly rising power curves from a closed valve condition. These pumps typically have a specific speed of 2000 and under. This method requires the manual input of power losses which do not factor according to the affinity laws to maintain accuracy over a wide operating speed range.

Moreover, the following devices are known and all fail to include logic that differentiates undesirable operating conditions to control the pump appropriately for each condition without the use of traditional sensors and/or auxiliary controls.

U.S. Pat. No. 6,591,697 discloses a technique for determining pump flow rates using motor torque measurements that provides methodology which explains the relationship of torque and speed versus pump flow rate and the ability to regulate pump flow using a Variable Frequency Drive (VFD) to adjust centrifugal pump speed. However, this device fails to include logic that would provide for protection against undesirable operating conditions. The device utilizes calibrated speed vs. torque curves which are application specific to obtain flow thereby reducing flexibility during field setup.

U.S. Pat. No. 6,464,464 B2, issued to the assignee of the present patent application, discloses a method and apparatus for controlling a pump system that provides a control and pump protection algorithm which uses a VFD to regulate flow, pressure or speed of a centrifugal pump. However, this device requires the use of instrumentation which adds cost and complexity to the drive system, a potential failure point, and unnecessary cost.

Another known device, PMP 25, by Load Controls, Inc. (Sturbridge, Mass.), provides pump protection by observing the motor amperage draw and speed and then correlating the resulting power reading to various operating conditions (e.g. dry running, closed valve condition). (See U.S. Pat. Nos. 5,930,092 and 5,754,421.) However, the Load Controls product is suitable only for constant speed applications and fails to provide control differentiation for various conditions; protective settings result in only "tripping" or shutting off of the motor.

U.S. Pat. No. 6,715,996 B2 discloses a method for the operation of a centrifugal pump that provides methodology which samples the pump power at a closed valve condition for two speeds, determines parasitic losses and calculates an adjusted power at other frequencies to determine if a condition exists which would lead to a malfunction of the motor. However, this technique only protects against zero flow condition it does not include logic to detect a minimum flow condition (flow too low) or runout condition (flow too high) nor can it distinguish between a no demand condition or dry run condition.

PCT WO 2005/064167 A1 discloses a quantitative measurement technique that provides methodology which uses a calibrated power/differential pressure curve vs. flow vs. speed. The calibrated data is stored and compared to current values in order to determine pump flow. However, this technique fails to include logic that would provide for protection against undesirable operating conditions. It also utilizes calibration curves for power/Δ pressure vs. flow at several speeds which are stored in the evaluation device. This method requires application specific data to obtain flow thereby reducing flexibility during field setup.

A product by ABB Industry Oy (Helsinki, Finland) provides a variable frequency drive (VFD) having parameters that allow maximum and minimum torque values to be configured to prevent the load driver (motor) from operating outside of these parameters. However, the ABB drive does not provide logic for interpreting different operating conditions, nor does it allow for scaling of centrifugal loads, such as pumps or take into account mechanical losses in small pumps at reduced speed.

A variable frequency drive system can be configured to utilize flow or pressure switches to identify undesired operating conditions. However, the use of additional process switches adds cost and complexity to the drive system, a potential failure point, and unnecessary cost.

Furthermore, the following patents were developed in a patentability search conducted in relation to the present invention. Below is a brief summary thereof:

United States Publication no. 2004/0064292 discloses a deep well centrifugal pump required to maintain an optimum level. It uses torque and speed data to calculate input power to the pump and uses pump affinity laws to adjust power to rated speed and determines a rated flow based on published pump data. It uses affinity law data and published performance to determine pump head, efficiency and minimum required suction head. The exact calculation method is not presented; it is shown only as flow as a function of power and head, and efficiency and suction head as a function of flow. The method simply calculates power and adjusts it for rated speed and determines flow from published performance data based on the affinity laws. Although widely used in the pump industry, affinity corrections to pump performance are not always accurate.

Although United States Publication no. 2004/0064292 discloses a control system for centrifugal pumps there is no tuning or calibration method involved. This method would require actual pump test data be used or risk introducing significant error. U.S. Pat. No. 6,709,241, which is issued to the assignee of the present application, discloses a technique that requires four sensors plus the input of actual performance data at several speeds in the variable frequency drive. It uses a flow sensor (external flowmeter) to compare actual flow to a threshold value for minimum flow but cannot distinguish between a minimum flow condition, a closed valve condition, a dry run condition or a runout condition.

United States Publication no. 2005/0123408 discloses a self calibration process to determine the minimum speed for which the pump pressure has increased by one increment. It is not used to calibrate power. The dry run protection is based on a comparison of an actual current reading to a threshold value for current. The threshold value is based on one operating speed.

U.S. Pat. Nos. 4,468,219 and 4,795,314 and United States Publication no. US2002/0141875 disclose peristaltic pumps or positive displacement pumps which behave very differently than centrifugal loads with respect to torque and speed.

U.S. Pat. No. 6,783,328 and United States Publication no. 2002/0150476 disclose techniques which require sensors to monitor flow or pressure to compare a setpoint value to a threshold value. If exceeded, the speed is lowered to bring the setpoint below the threshold value.

U.S. Pat. No. 4,650,633 discloses a method that restricts flow to the pump to prevent cavitation based on sensors which detect liquid temperature and pressure at the pump inlet.

Based on an understanding and appreciation of the known prior art discussed above, there is a need in the industry for a technique that provides protection for centrifugal pumps without the use of traditional sensors which can differentiate between dangerous operating conditions (e.g. dry running, minimum flow and runout) and/or conditions where transient conditions (e.g. closed valve operation) may occur and the protection can be revoked once the condition clears.

SUMMARY OF THE INVENTION

The present invention provides a new and unique method and apparatus for pump protection without using traditional sensors by calculating a flow value for comparison to a threshold flow value from a field calibrated speed vs closed valve power curve stored in the evaluation device, motor signals for speed and power (or torque) plus basic published pump performance data such as best efficiency power, closed valve power and best efficiency flow at the rated pump speed.

The calculated flow input used for comparison to a threshold flow value can also be taken from one of many techniques for calculating flow using pump affinity law data and flow calibration curves at various speeds stored in an evaluation device and pump and motor signals such as speed and power (or torque), or speed and power/differential pressure.

The method for controlling the operation of the pump features comparing an actual flow value and a corrected threshold flow value that is corrected based on the speed of the pump in order to determine the pump operating condition. The reaction to operation of the pump may be adapted based on the comparison.

The correction to the threshold flow value is based on a relationship between an actual pump speed and a rated pump speed.

The corrected threshold flow value may include a runout condition value (too much flow), a minimum flow value (too little flow), or some combination thereof, and the method may include comparing a corrected runout condition threshold value to an actual runout flow value in order to determine a runout condition of the pump.

The method may also include comparing a corrected minimum flow threshold value to an actual minimum flow value in order to determine either a normal flow condition or a possible minimum flow condition of the pump, alone or together with steps for comparing a corrected minimum flow threshold value to an actual flow value, and an actual power value to a closed valve power value at the current speed of the pump, in order to determine whether a minimum flow condition or a dry run condition of the pump exists. Embodiments also may include either the actual power value, the closed valve power value or the combination thereof being corrected for specific gravity of the medium being pumped.

In effect, the calculated flow value may be compared to threshold values of flow associated with these adverse operating conditions. The current operating values for speed, power or torque can be compared to a field calibrated speed vs closed valve power curve stored in the evaluation device and basic published pump performance data such as best efficiency power, closed valve power and best efficiency flow at rated pump speed to calculate the actual flow or can be compared to calibration curves stored in an evaluation device for flow vs power (or torque) or flow vs power/differential pressure in order to determine the actual flow value. In cases where the installation includes a flowmeter, it can be used as direct input to the pump protection algorithm. The logic can be embedded in a Variable Frequency Drive or Programmable Logic Controller.

The present invention may also include a controller having a module configured for implementing the features set forth above, as well as a pump system having such a controller.

In one embodiment as disclosed in US2004/0064292, protection is based on measured torque and speed from the drive to calculate power and compares calculated power to a maximum power threshold corrected for speed based on affinity laws. The method according to the present invention uses a sensorless flow value derived from a calibrated closed valve power vs speed curve to create a more accurate speed corrected power vs flow curve than is possible using affinity laws alone. The sensorless flow value is then compared to threshold values for minimum flow and runout flow. A check is also made for dry running by comparing the calibrated closed valve power to actual power at the current operating speed and liquid specific gravity.

In effect, the present invention provides protection for centrifugal pumps while differentiating between dangerous operating conditions (e.g. dry running, minimum flow and runout) and/or conditions where transient conditions (e.g. closed valve operation) may occur and the protection can be revoked once the condition clears. The methodology utilizes a calculated flow value which may be compared to threshold values of flow associated with these adverse operating conditions. The current operating values for speed, power or torque can be compared to a field calibrated speed vs closed valve power curve stored in the evaluation device and along with basic published pump performance data such as best efficiency power, closed valve power and best efficiency flow at rated pump speed to calculate the flow or can be compared to flow vs power (or torque) or flow vs power/differential pressure calibration curves at various speeds stored in an evaluation device. The calculated flow value is then compared to threshold values of flow associated with these adverse operating conditions.

Finally, it is important, to note that the present invention calibrates pump power vs speed at closed valve condition and adjusts published performance to reflect actual performance based on the calibration curve to more accurately determine power vs flow at the operating speed than that disclosed in the aforementioned 2004/0064292 publication.

BRIEF DESCRIPTION OF THE DRAWING

FIG. 1 is a block diagram of a basic pump system according to the present invention.

FIG. 2 is a flowchart of basic steps performed according to the present invention by the controller shown in FIG. 1.

FIG. 3 is a block diagram of a controller shown in FIG. 1 for performing the basic steps shown in FIG. 2.

DETAILED DESCRIPTION OF THE INVENTION

FIG. 1 shows the basic pump system generally indicated as 2 according to the present invention, having a controller 4, a motor 6 and a pump 8. In operation, the controller 4 according to the present invention determines the calculated flow value from a field calibrated speed vs closed valve power curve stored in the evaluation device and motor signals for speed and power (or torque) plus basic published pump performance data such as best efficiency power, closed valve power and best efficiency flow at the rated pump speed. The calculated flow input used for comparison to a threshold flow 15, value can also be taken from one of many techniques for calculating flow using pump affinity law data and flow calibration curves at various speeds stored in an evaluation device or module (such as module 4*a* in FIG. 3) and pump and motor signals such as speed and power (or torque), or speed and power/differential pressure. In cases where the installation includes a flowmeter, it can be used as direct input to the pump protection algorithm.

In particular, the controller 4 controls the operation of the pump 8 with a module 4*a* (see FIG. 3) configured for comparing an actual flow value and a corrected threshold flow value that is corrected based on the speed of the pump 8 in order to determine the pump operating condition. The operation of the pump 8 may be adapted based on the comparison, including using a user settable delay in reacting to the condition prior to issuing either a warning only, warning and reduction in speed to a safe operating speed, faulting and shutting down the motor or automatically resetting the fault and restarting the pump and motor to check if the condition has cleared. If the condition clears the adaptation is revoked and the pump resumes normal operation. The correction is based on a relationship between an actual pump speed and a rated pump speed consistent with that described below.

The corrected threshold flow value may include a runout condition value, a minimum flow value, or some combination thereof, and the module 4*a* may be configured for comparing a corrected runout condition threshold value to an actual runout flow value in order to determine a runout condition of the pump 8.

The module 4*a* may also be configured for comparing a corrected minimum flow threshold value to an actual minimum flow value in order to determine either a normal flow condition or a possible minimum flow condition of the pump, alone or together with steps for comparing a corrected minimum flow threshold value to an actual flow value, and an actual power value to a closed valve power value at the current speed of the pump, in order to determine whether a minimum flow condition or a dry run condition of the pump exists. Embodiments also may include either the actual power value, the closed valve power value or the combination thereof being corrected for specific gravity of the medium being pumped.

In effect, the calculated flow value may be compared to threshold values of flow associated with these adverse operating conditions. The current operating values for speed, power or torque can be compared to a field calibrated speed vs closed valve power curve stored in the evaluation device and along with basic published pump performance data such as best efficiency power, closed valve power and best efficiency flow at rated pump speed to calculate the flow or can be compared to flow vs power (or torque) or flow vs power/differential pressure calibration curves at various speeds stored in an evaluation device or module 4*a* in order to determine the actual flow value. In cases where the installation includes a flowmeter (not shown), it can be used as direct input to the pump protection algorithm implemented in the controller 4. The control logic can be embedded in a controller such as 4*a* which may take the form of a Variable Frequency Drive (VFD) or Programmable Logic Controller (PLC), as shown.

The motor 6 and pump 8 are known in the art and not described in detail herein. Moreover, the scope of the invention is not intended to be limited to any particular type or kind thereof that is either now known or later developed in the future. Moreover still, the scope of the invention is also intended to include using the technique according to the present invention in relation to controlling the operation of a centrifugal pump, centrifugal mixer, centrifugal blower or centrifugal compressor.

In effect, the present invention consists of and may be implemented with control logic that utilizes the direct feedback of power (or torque) and speed from the motor 6 and the pump 8 to calculate a flow value in order to identify undesirable operating conditions and provide the appropriate operating response to protect the driven machine (centrifugal pump) from damage. The calculated flow value is then compared to threshold values of flow associated with these adverse operating conditions. Alternatively, the current operating values for speed, power or torque can be compared to calibrated flow vs. power (or torque) or power/differential pressure curves stored in an evaluation device in order to determine the actual flow value. Alternately, in cases where the installation includes a flowmeter it can be used as direct input to the pump protection algorithm.

FIG. 2

The Control Logic

FIG. 2 shows, by way of example, a flowchart generally indicated as 10 having the basic steps 12-18 of the pump protection algorithm or control logic that may be implemented by the controller 4 according to the present invention. The pump protection algorithm or control logic may be embedded in the Variable Frequency Drive or Programmable Logic Controller like that shown above in relation to the controller 4 in FIG. 1. Many current VFD systems create accurate mathematical models of the motors being driven in order to provide precise control over speed and torque. Given this information, the protection logic according to the present invention may be implemented as follows:

The inputs may include:

Minimum Speed

Maximum Speed

Rated Speed $Q_{MIN}$ the Minimum Flow Threshold at rated speed (flow too low)

$Q_{RO}$ the Runout Flow Threshold at rated speed (flow too high)

$K_{DR}$—a coefficient multiplied by the closed valve power at the current operating speed, which may be used for determining a dry run condition.

Protection Delay—a time delay in seconds prior to declaring a protection condition.

Based on the current operating speed, the minimum flow and runout flow threshold values are corrected as follows:

$Q_{MIN_COR=QMIN}\times(N_{ACT}/N_{RATED})$ $Q_{RO_COR=QRO}\times(N_{ACT}/N_{RATED})$ Where:

$Q_{MIN_COR}$ is the minimum flow corrected for speed $Q_{RO_COR}$ is the runout flow corrected for speed $N_{ACT}$ is the actual speed $N_{RATED}$ is the rated speed Once a condition is declared the logic provides for the following actions depending on settings:

Runout Condition 13

A RUNOUT protection condition 13 is declared if the actual flow is greater than the RUNOUT Flow setting corrected for speed.

The reaction of the drive is to warn the user with no further action taken. A protection delay period can be set prior to declaring a RUNOUT condition. If the runout condition clears, the RUNOUT warning will clear.

Minimum Flow Condition 17

A MIN FLOW protection condition 17 is declared if the actual flow is less than the MIN Flow setting corrected for speed and $P_{ACT}$ is greater than $K_{DE}\times P_{SO_N}$, Where:

$K_{DR}$ is a dry run coefficient, $P_{ACT}$ is the actual power corrected for a specific gravity=1, and $P_{SO_N}$ is the closed valve power at the current speed corrected for a specific gravity=1. $P_{SO_N}$ interpolated from a closed valve power vs speed curve stored in an evaluation device. Alternatively, $P_{SO_N}$ can be calculated by the affinity laws as follows: $P_{SO_N}=P_{SO}$ (rated speed)×(N actual speed/N rated speed)$^{KSO}$ where KSO is typically equal to 3.0. For small hp pumps a correction can be made to $K_{DR}$ to compensate for inaccuracies in $P_{SO_N}$ if the affinity calculation method is used. Then $K_{DR}$ corr=$K_{DR}$×(N actual speed/N rated speed)$^{0.5}$=$K_{DR}$ and the equation in FIG. 2 becomes $P_{ACT}<K_{DR}$ corr$\times P_{SO_N}$.

The reaction of the drive can be set to either warn the user with no further action taken, warn the user and slow down to a safe minimum operating speed (alarm & control) or fault and shutdown the unit. A protection delay period can be set prior to declaring a MIN FLOW condition. The drive can also be set to automatically reset an alarm and control condition or a fault to check if the system transient condition has cleared. The number of resets and time between resets is adjustable by the user. Once the number of resets is exhausted, if the condition has not cleared, the unit will remain off until restarted manually by the user.

Dry Run Condition 18

A DRY RUN protection condition 18 is declared if $P_{ACT}$ is less than $K_{DR}\times P_{SO_N}$.

The reaction of the drive can be set to either warn the user with no further action taken or fault and shutdown the unit. A protection delay period can be set prior to declaring a DRY RUN condition. The drive cannot be set to automatically reset a fault condition. Once the unit has faulted it will remain off until restarted by the user.

It is noted that the scope of the present invention includes all functionality being selectively disabled by the user.

FIG. 3

The Controller 4

FIG. 3 shows the basic modules 4*a* and 4*b* of the controller 4. Many different types and kind of controllers and control modules for controlling pumps are known in the art. Based on an understanding of such known controllers and control modules, a person skilled in the art would be able to implement a control module such as 4*a* and configure the same to perform functionality consistent with that described herein, including comparing an actual flow value and a corrected threshold flow value that is corrected based on the speed of the pump in order to determine the pump operating condition, as well as for implementing the other basic steps of the present invention, such as that shown in FIG. 2 and described above, in accordance with the present invention. By way of example, the functionality of the module 4*a* may be implemented using hardware, software, firmware, or a combination thereof, although the scope of the invention is not intended to be limited to any particular embodiment thereof. In a typical software implementation, such a module would be one or more microprocessor-based architectures having a microprocessor, a random access memory (RAM), a read only memory (ROM), input/output devices and control, data and address buses connecting the same. A person skilled in the art would be able to program such a microprocessor-based implementation to perform the functionality described herein without undue experimentation. The scope of the invention is not intended to be limited to any particular implementation using technology known or later developed in the future.

The controller has other controller modules 4*b* that are known in the art, that do not form part of the underlying invention, and that are not described in detail herein.

Other Possible Applications

1. Pump Load Monitors: Pump load monitors rely upon an accurate modeling of the pump power curve to identify minimum flow and shut-off conditions. While most load monitors only monitor power at one speed, this logic would enable more accurate load monitors for variable speed operation.

2. Pump Protection Algorithms: Sensorless flow measurements can give a reliable indication of operating conditions: runout conditions (flow too high), operation below minimum pump flow (flow too low) or operation against a closed discharge valve.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

We claim:

1. A method for controlling the operation of a pump, including a centrifugal pump, centrifugal mixer, centrifugal blower or centrifugal compressor, comprising:

determining an actual flow value without using a flow or pressure sensor based at least partly on a comparison of speed and power sensed in relation to the current operation of the pump and information contained in a calibrated curve of speed versus closed valve power together with published pump performance data, including best efficiency power, closed valve power and best efficiency flow at rated pump speed;

determining a corrected threshold flow value based at least partly on a flow value associated with an unfavorable operating condition of the pump and corrected based on a relationship between a current operating speed of the pump and a rated operating speed of the pump; and controlling the operation of the pump based at least partly on a comparison between the actual flow value and the corrected threshold flow value in order to provide pump protection for the pump.

2. A method according to claim 1, wherein the method further comprises adapting the operation of the pump based at least partly on the comparison, including using a user settable delay in reacting to the condition prior to issuing either a warning only, warning and reduction in speed to a safe operating speed, faulting and shutting down the motor or automatically resetting the fault and restarting the pump and motor to check if the condition has cleared, and where if the condition clears the adaptation is revoked and the pump resumes normal operation.

3. A method according to claim 1, wherein the relationship is a ratio of the current operating speed of the pump divided by the rated operating speed of the pump.

4. A method according to claim 1, wherein the corrected threshold flow value includes a runout condition value, a minimum flow value, or some combination thereof.

5. A method according to claim 1, wherein the method includes comparing a runout condition value to an actual runout flow value in order to determine a runout condition of the pump.

6. A method according to claim 1, wherein the method includes comparing a corrected minimum flow value to an actual minimum flow value in order to determine either a normal flow condition or a possible minimum flow condition of the pump.

7. A method according to claim 1, wherein the method further comprises comparing, a corrected minimum threshold flow value to an actual flow value and also comparing an actual power value to a closed valve power value at the current speed of the pump in order to determine either a minimum flow condition or a dry run condition of the pump.

8. A method according to claim 1, wherein the method further comprises comparing a corrected minimum threshold flow value to an actual flow value and also comparing an actual power value to a closed valve power value at the current speed of the pump in order to determine either a minimum flow condition or a dry run condition of the pump, where the closed valve power value is interpolated from a calibrated power vs speed curve stored in a memory device.

9. A method according to claim 1, wherein a Dry Run condition is declared if $P_{ACT}$ is less than $K_{DR} \times P_{SO_N}$, where $P_{ACT}$ is an actual power corrected for a specific gravity of 1, where $K_{DR}$ is a coefficient multiplied by a closed valve power at a current operating speed, and where $P_{SO_N}$ is the closed valve power at the current speed corrected for the specific gravity of 1.

10. A method according to claim 7, wherein either the actual power value, the closed valve power value or the combination thereof are corrected for specific gravity of the medium being pumped.

11. A method according to claim 7, wherein the corrected Minimum Flow Threshold value is based at least partly on the equation $Q_{MIN_COR} = Q_{MIN} \times (N_{ACT}/N_{RATED})$, where $Q_{MIN_COR}$ is a minimum flow corrected for speed, where $Q_{MIN}$ is the minimum flow, where $N_{ACT}$ is an actual speed, and where $N_{RATED}$ is a rated speed.

12. A method according to claim 5, wherein the runout condition value is a corrected Runout Flow Threshold value that is based at least partly on the equation $Q_{RO_COR} = Q_{RO} \times (N_{ACT}/N_{RATED})$, where $Q_{RO_COR}$ is a runout flow corrected for speed, where $Q_{RO}$ is the runout flow, where $N_{ACT}$ is an actual speed, and where $N_{RATED}$ is a rated speed.

13. A controller for controlling the operation of a pump, including a centrifugal pump, centrifugal mixer, centrifugal blower or centrifugal compressor, comprising:

at least one module configured to determine an actual flow value without using a flow or pressure sensor based at least partly on a comparison of speed and power sensed in relation to the current operation of the pump and information contained in a calibrated curve of speed versus closed valve power together with published pump performance data, including best efficiency power, closed valve power and best efficiency flow at rated pump speed;

determine a corrected threshold flow value based at least partly on a flow value associated with an unfavorable operating condition of the pump and corrected based on a relationship between a current operating speed of the pump and a rated operating speed of the pump; and control the operation of the pump based at least partly on a comparison between the actual flow value and the corrected threshold flow value in order to provide pump protection for the pump.

14. A controller according to claim 13, wherein the module is configured to adapt the operation of the pump based at least partly on the comparison, including using a user settable delay in reacting to the condition prior to issuing either a warning only, warning and reduction in speed to a safe operating speed, faulting and shutting down the motor or automatically resetting the fault and restarting the pump and motor to check if the condition has cleared, and where the condition clears the adaptation is revoked and the pump resumes normal operation.

15. A controller according to claim 13, wherein the relationship is a ratio of the current operating speed of the pump divided by the rated operating speed of the pump.

16. A controller according to claim 13, wherein the corrected threshold flow value includes a runout condition value, a minimum flow value, or some combination thereof.

17. A controller according to claim 13, wherein the at least one module is configured to compare a runout condition value to an actual runout flow value in order to determine a runout condition of the pump.

18. A controller according to claim 13, wherein the at least one module is configured to compare a corrected minimum flow value to an actual minimum flow value in order to determine either a normal flow condition or a possible minimum flow condition of the pump.

19. A controller according to claim 13, wherein the at least one module is configured to compare a corrected minimum threshold flow value to an actual flow value and also compare an actual power value to a closed valve power value at the current speed of the pump in order to determine either a minimum flow condition or a dry run condition of the pump.

20. A controller according to claim 13, wherein the at least one module is configured to compare a corrected minimum threshold flow value to an actual flow value, and also compare an actual power value to a closed valve power value at the current speed of the pump, in order to determine either a minimum flow condition or a dry run condition of the pump, where the closed valve power value is interpolated from a calibrated power vs speed curve stored in a memory device.

21. A controller according to claim 13, wherein a Dry Run condition is declared if $P_{ACT}$ is less than $K_{DR} \times P_{SO_N}$, where $P_{ACT}$ is an actual power corrected for a specific gravity of 1, where $K_{DR}$ is a coefficient multiplied by a closed valve power at a current operating speed, and where $P_{SO_N}$ is the closed valve power at the current speed corrected for the specific gravity of 1.

22. A controller according to claim 19, wherein either the actual power value, the closed valve power value or the combination thereof are corrected for specific gravity of the medium being pumped.

23. A controller according to claim 19, wherein the corrected Minimum Flow Threshold value is based at least partly on the equation $Q_{MIN_COR=QMIN} \times (N_{ACT}/N_{RATED})$, where $Q_{MIN_COR}$ is a minimum flow corrected for speed, where $Q_{MIN}$ is a minimum flow, where $N_{ACT}$ is an actual speed, and where $N_{RATED}$ is a rated speed.

24. A controller according to claim 13, wherein the runout condition value is a corrected Runout Flow Threshold value that is based at least partly on the equation $Q_{RO_COR}=Q_{RO} \times (N_{ACT}/N_{RATED})$, where $Q_{RO_COR}$ is a runout flow corrected for speed, where $Q_{RO}$ is the runout flow, where $N_{ACT}$ is an actual speed, and where $N_{RATED}$ is a rated speed.

25. A controller according to claim 13, wherein the controller is a variable frequency controller or a programmable logic controller.

26. A centrifugal pump system or system with other centrifugal device such as a centrifugal mixer, centrifugal blower or centrifugal compressor having a controller for controlling the operation of a pump, including a centrifugal pump, centrifugal mixer, centrifugal blower or centrifugal compressor, the controller comprising:

at least one module configured to determine an actual flow value without using a flow or pressure sensor based at least partly on a comparison of speed and power sensed in relation to the current operation of the pump and information contained in a calibrated curve of speed versus closed valve power together with published pump performance data, including best efficiency power, closed valve power and best efficiency flow at rated pump speed;

determine a corrected threshold flow value based at least partly on a flow value associated with an unfavorable operating condition of the pump and corrected based on a relationship between a current operating speed of the pump and a rated operating speed of the pump; and control the operation of the pump based at least partly on a comparison between the actual flow value and the corrected threshold flow value in order to provide pump protection for the pump.

27. A pump system according to claim 26, wherein the at least one module is configured to adapt the operation of the pump based at least partly on the comparison, including using a user settable delay in reacting to the condition prior to issuing either a warning only, warning and reduction in speed to a safe operating speed, faulting and shutting down the motor or automatically resetting the fault and restarting the pump and motor to check if the condition has cleared, and where if the condition clears the adaptation is revoked and the pump resumes normal operation.

28. A pump system according to claim 26, wherein the relationship is a ratio of the current operating speed of the pump divided by the rated operating speed of the pump.

29. A pump system according to claim 26, wherein the corrected threshold flow value includes a runout condition value, a minimum flow value, or some combination thereof.

30. A pump system according to claim 26, wherein the at least one module is configured to compare a runout condition value to an actual runout flow value in order to determine a runout condition of the pump.

31. A pump system according to claim 26, wherein the at least one module is configured to compare a corrected minimum flow value to an actual minimum flow value in order to determine either a normal flow condition or a possible minimum flow condition of the pump.

32. A pump system according to claim 26, wherein the at least one module is configured to compare a corrected minimum threshold flow value to an actual flow value and also comparing an actual power value to a closed valve power value at the current speed of the pump in order to determine either a minimum flow condition or a dry run condition of the pump.

33. A pump system according to claim 26, wherein the method further comprises comparing, a corrected minimum threshold flow value to an actual flow value and also comparing an actual power value to a closed valve power value at the current speed of the pump in order to determine either a minimum flow condition or a dry run condition of the pump, and where the closed valve power value is interpolated from a calibrated power vs speed curve stored in a memory device.

34. A pump system according to claim 26, wherein a Dry Run condition is declared if $P_{ACT}$ is less than $K_{DR} \times P_{SO_N}$, where $P_{ACT}$ is an actual power corrected for a specific gravity of 1, where $K_{DR}$ is a coefficient multiplied by a closed valve power at a current operating speed, and where $P_{SO_N}$ is the closed valve power at the current speed corrected for the specific gravity of 1.

35. A pump system according to claim 26, wherein either the actual power value, the closed valve power value or the combination thereof are corrected for specific gravity of the medium being pumped.

36. A pump system according to claim 33, wherein the corrected Minimum Flow Threshold value is based at least partly on the equation $Q_{MIN_COR}=Q_{MIN} \times (N_{ACT}/N_{RATED})$, where $Q_{MIN_COR}$ is a minimum flow corrected for speed, where $Q_{MIN}$ is the minimum flow, where $N_{ACT}$ is an actual speed, and where $N_{RATED}$ is a rated speed.

37. A pump system according to claim 26, wherein the runout condition value is a corrected Runout Flow Threshold value that is based on the equation $Q_{RO_COR}=Q_{RO} \times (N_{ACT}/N_{RATED})$, where $Q_{RO_COR}$ is a runout flow corrected for speed, where $Q_{RO}$ is the runout flow, where $N_{ACT}$ is an actual speed, and where $N_{RATED}$ is a rated speed.

38. A pump system according to claim 26, wherein the controller is a variable frequency controller or a programmable logic controller.

39. A method according to claim 4, wherein the method includes comparing a runout condition value to an actual runout flow value in order to determine a runout condition of the pump.

40. A method according to claim 8, wherein a Dry Run condition is declared if $P_{ACT}$ is less than $K_{DR}$ X $P_{SO_N}$, where $P_{ACT}$ is an actual power corrected for a specific gravity of 1, where $K_{DR}$ is a coefficient multiplied by a closed valve power at a current operating speed, and where $P_{SO_N}$ is the closed valve power at the current speed corrected for the specific gravity of 1.

41. A method according to claim 7, wherein the corrected Minimum Flow Threshold value is based at least partly on the equation $Q_{MIN_COR}=Q_{MIN}\times(N_{ACT}/N_{RATED})$, where $Q_{MIN_COR}$ is a minimum flow corrected for speed, where $Q_{MIN}$ is the minimum flow, where $N_{ACT}$ is an actual speed, and where $N_{RATED}$ is a rated speed.

42. A method according to claim 5, wherein the corrected Runout Flow Threshold value is based at least partly on the equation $Q_{RO_COR}=Q_{RO}\times(N_{ACT}/N_{RATED})$, where $Q_{RO_COR}$ is a runout flow corrected for speed, where $Q_{RO}$ is the runout flow, where $N_{ACT}$ is an actual speed, and where $N_{RATED}$ is a rated speed.

43. A method according to claim 7, wherein the actual flow value is calculated from a calibrated speed vs closed valve power curve stored in the evaluation device, motor signals for speed and power (or torque) and basic published pump performance data such as best efficiency power, closed valve power and best efficiency flow at the rated pump speed.

44. A controller according to claim 16, wherein the at least one module is configured to compare a runout condition value to an actual runout flow value in order to determine a runout condition of the pump.

45. A controller according to claim 20, wherein a Dry Run condition is declared if $P_{ACT}$ is less than $K_{DR}$ X $P_{SO_N}$, where $P_{ACT}$ is an actual power corrected for a specific gravity of 1, where $K_{DR}$ is a coefficient multiplied by a closed valve power at a current operating speed, and where $P_{SO_N}$ is the closed valve power at the current speed corrected for the specific gravity of 1.

46. A controller according to claim 20 wherein the corrected Minimum Flow Threshold value is based at least partly on the equation $Q_{MIN_COR}=Q_{MIN}\times(N_{ACT}/N_{RATED})$, where $Q_{MIN_COR}$ is a minimum flow corrected for speed, where $Q_{MIN}$ is the minimum flow, where $N_{ACT}$ is an actual speed, and where $N_{RATED}$ is a rated speed.

47. A controller according to claim 17, wherein the corrected Runout Flow Threshold value is based at least partly on the equation $Q_{RO_COR}=Q_{RO}\times(N_{ACT}/N_{RATED})$, where $Q_{RO_COR}$ is a runout flow corrected for speed, where $Q_{RO}$ is the runout flow, where $N_{ACT}$ is an actual speed, and where $N_{RATED}$ is a rated speed.

48. A controller according to claim 19, wherein the actual flow value is calculated from a calibrated speed vs closed valve power curve stored in the evaluation device, motor signals for speed and power (or torque) and basic published pump performance data such as best efficiency power, closed valve power and best efficiency flow at the rated pump speed.

49. A pump system according to claim 29, wherein the at least one module is configured to compare a runout condition value to an actual runout flow value in order to determine a runout condition of the pump.

50. A pump system according to claim 33, wherein a Dry Run condition is declared if $P_{ACT}$ is less than $K_{DR}$ X $P_{SO_N}$, where $P_{ACT}$ is an actual power corrected for a specific gravity of 1, where $K_{DR}$ is a coefficient multiplied by a closed valve power at a current operating speed, and where $P_{SO_N}$ is the closed valve power at the current speed corrected for the specific gravity of 1.

51. A pump system according to claim 32, wherein either the actual power value, the closed valve power value or the combination thereof are corrected for specific gravity of the medium being pumped.

52. A pump system according to claim 32, wherein the corrected Minimum Flow Threshold value is based at least partly on the equation $Q_{MIN_COR}=Q_{MIN}\times(N_{ACT}/N_{RATED})$, where $Q_{MIN_COR}$ is a minimum flow corrected for speed, where $Q_{MIN}$ is the minimum flow, where $N_{ACT}$ is an actual speed, and where $N_{RATED}$ is a rated speed.

53. A pump system according to claim 30, wherein the corrected Runout Flow Threshold value is based at least partly on the equation $Q_{RO_COR}=Q_{RO}\times(N_{ACT}/N_{RATED})$, where $Q_{RO_COR}$ is a runout flow corrected for speed, where $Q_{RO}$ is the runout flow, where $N_{ACT}$ is an actual speed, and where $N_{RATED}$ is a rated speed.

54. A pump system according to claim 32, wherein the actual flow value is calculated from a calibrated speed vs closed valve power curve stored in the evaluation device, motor signals for speed and power (or torque) and basic published pump performance data such as best efficiency power, closed valve power and best efficiency flow at the rated pump speed.

* * * * *